US005502985A

United States Patent [19]

Matsuda et al.

[11] Patent Number: 5,502,985

[45] Date of Patent: Apr. 2, 1996

[54] KNIT SLIDE FASTENER

[75] Inventors: Yoshio Matsuda; Yoshito Ikeguchi, both of Toyama, Japan

[73] Assignee: YKK Corporation, Tokyo, Japan

[21] Appl. No.: 493,094

[22] Filed: Jun. 21, 1995

[30] Foreign Application Priority Data

Jun. 23, 1994 [JP] Japan ..... 6-174669

[51] Int. Cl.[6] ..... D04B 21/20; D04B 21/14; A44B 19/56

[52] U.S. Cl. ..... 66/193; 66/190; 66/192; 66/195; 24/392

[58] Field of Search ..... 66/190, 192, 193, 66/194, 195; 24/391, 392, 393, 397, 398

[56] References Cited

U.S. PATENT DOCUMENTS

| | | | |
|---|---|---|---|
| 3,996,773 | 12/1976 | Matsuda | 66/195 X |
| 4,051,579 | 10/1977 | Heimberger | 66/195 X |
| 4,075,874 | 2/1978 | Heimberger | 66/190 X |
| 4,135,555 | 1/1979 | Mausbach | 24/392 X |
| 4,137,733 | 2/1979 | Heimberger | 66/195 |
| 4,467,840 | 8/1984 | Tsubata | 24/392 X |

FOREIGN PATENT DOCUMENTS

| | | | |
|---|---|---|---|
| 2179222 | 11/1973 | France | 24/392 |
| 2114700 | 10/1972 | Germany | 66/193 |
| 2093873 | 9/1982 | United Kingdom | 66/193 |

*Primary Examiner*—John J. Calvert
*Attorney, Agent, or Firm*—Hill, Steadman & Simpson

[57] ABSTRACT

A knit slide fastener of the type including a warp-knit fastener tape having a ground structure composed of chain stitches, and a row of continuous coupling elements knit into and along an element-supporting portion of one longitudinal edge portion of the fastener tape as the fastener tape is knit, wherein binding chain stitches are knit into the element-supporting portion to secure the row of coupling elements to the longitudinal tape edge portion, the binding chain stitches having sinker loops urging pairs of legs of the coupling elements toward the element-supporting portion, and needle loops intertwined with needle loops of the chain stitches of the ground structure. With this arrangement, the longitudinal tape edge portion has a knit structure which is relatively tight and substantially non-stretchable in the longitudinal direction. The row of coupling elements attached to such tight and longitudinally non-stretchable longitudinal tape edge portion is highly stable in position and resistant to deformation.

3 Claims, 10 Drawing Sheets

KNIT SLIDE FASTENER

BACKGROUND OF THE INVENTION

1. Field of the Invention

The present invention relates to a knit slide fastener having a row of continuous coupling elements knit into and along one longitudinal edge portion of a knit fastener tape as the fastener tape is knit.

2. Description of the Prior Art

A conventional knit slide fastener disclosed, for example, in Japanese Patent Publication No. 38-11673 includes a fastener tape knit with chain stitches and laid-in weft threads and having a longitudinal edge portion into and along which a row of continuous coupling elements formed from a nylon monofilament is knit. The nylon monofilament is laid transversely across the longitudinal tape edge portion and shaped into the row of coupling elements knit successively in the chain stitches as the fastener tape is knit. Another known knit slide fastener disclosed in U.S. Pat. No. 5,035,125 includes a fastener tape knit with chain stitches and a laid-in weft thread, and a row of continuous coupling elements formed from a plastic monofilament laid in and along one longitudinal edge portion of the fastener tape. In the longitudinal tape edge portion, the laid-in weft thread is interlaced with the chain stitches running along two adjacent wales to downwardly urge the upper legs of the coupling elements, and also with the chain stitches running along a neighboring wale to downwardly urge the lower legs of the coupling elements.

The conventional knit slide fasteners previously described are of the type including a fastener tape knit with chain stitches and laid-in weft threads, and a plastic monofilament laid into one longitudinal edge portion of the fastener tape so as to form a row of continuous coupling elements knit into and along the longitudinal tape edge portion. In the first-mentioned knit slide fastener, the row of coupling elements is secured by sinker loops of the chain stitches provided to form a ground structure of the fastener tape. Since the chain stitches are longitudinally stretchable, the row of coupling elements thus attached is dimensionally instable and is likely to be deformed when the chain stitches are stretched. The row of coupling elements thus deformed is no longer able to insure a smooth interlocking engagement with a mating row of coupling elements. In the second-mentioned knit slide fastener, needle loops of the chain stitches are merely interlaced with the laid-in weft thread extending transversely across the longitudinal tape edge portion, and the chain stitches urging the legs of the coupling elements downwardly also consists a portion of the ground structure. The chain stiches thus arranged are also readily stretchable in the longitudinal direction and hence cannot secure the coupling elements with sufficient dimensional stability. A smooth interlocking engagement between the opposed rows of coupling elements is, therefore, difficult to achieve.

SUMMARY OF THE INVENTION

With the foregoing drawbacks of the prior art in view, it is an object of the present invention to provide a knit slide fastener which has a row of continuous coupling elements firmly secured to one longitudinal edge portion of a knit fastener tape with sufficient dimensional stability to insure a smooth interlocking engagement between two rows of coupling elements.

To attain the foregoing object, the prevent invention provides a knit slide fastener of the type having a warp-knit fastener tape composed of a ground structure including chain stitches, and a row of continuous coupling elements knit into and along an element-supporting portion of one longitudinal edge portion of the fastener tape as the fastener tape is knit. The improvement of the knit slide fastener comprises: binding chain stitches knit into the longitudinal edge portion of the warp-knit fastener tape to secure the row of coupling elements, the binding chain stitches having sinker loops arranged to urge the legs of the coupling elements toward the longitudinal tape edge portion, and needle loops intertwined with needle loops of the chain stitches of the ground structure.

Preferably, the knit slide fastener further includes tricot stitches forming a portion of the ground structure. Sinker loops of the tricot stitches are arranged to urge the legs of the coupling elements toward the longitudinal tape edge portion in cooperation with the sinker loops of the binding chain stitches, and needle loops of the tricot stitces are intertwined with the needle loops of the chain stitches of the ground structure so that the coupling elements are anchored to the tape edge portion as the slide fastener is knit. Preferably, at least the binding chain stitches are composed of heat-shrinkable threads having a greater thickness than threads consisting the ground structure.

At the element-supporting portion of the one longitudinal tape edge portion, the row of coupling elements is attached to the ground structure of the fastener tape not by means of stitches forming at least a portion of the ground structure but by using the binding chain stitches provided exclusively for this purpose. The chain stitches are arranged such that sinker loops of the binding chain stitches urge the legs of the coupling elements toward the ground structure, and needle loops of the binding chain stitches are intertwined with needle loops of the chain stitches of the ground structure. The row of coupling elements is knit in the element-supporting portion of the longitudinal tape edge portion and anchored in position by the binding chain stitched as the fastener tape including the binding chain stitches is knit.

With this construction, the ground structure of the fastener tape can retain its shape and strength even at its one longitudinal edge portion provided for the attachment of the row of coupling elements. In addition, since the needle loops of the binding chain stitches are intertwined with the needle loops of the chain stitches of the ground structure, the legs of the coupling elements are strongly urged toward a surface of the fastener tape via the sinker loops of the binding chain stitches. The binding chain stitches are arranged to embrace the individual coupling elements from the above and urge them toward the longitudinal tape edge portion, with the result that the row of coupling elements is firmly secured to the longitudinal tape edge portion with high dimensional stability and hence is able to insure a reliable interlocking engagement with a mating row of coupling elements and subsequent smooth sliding movement of the slider.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
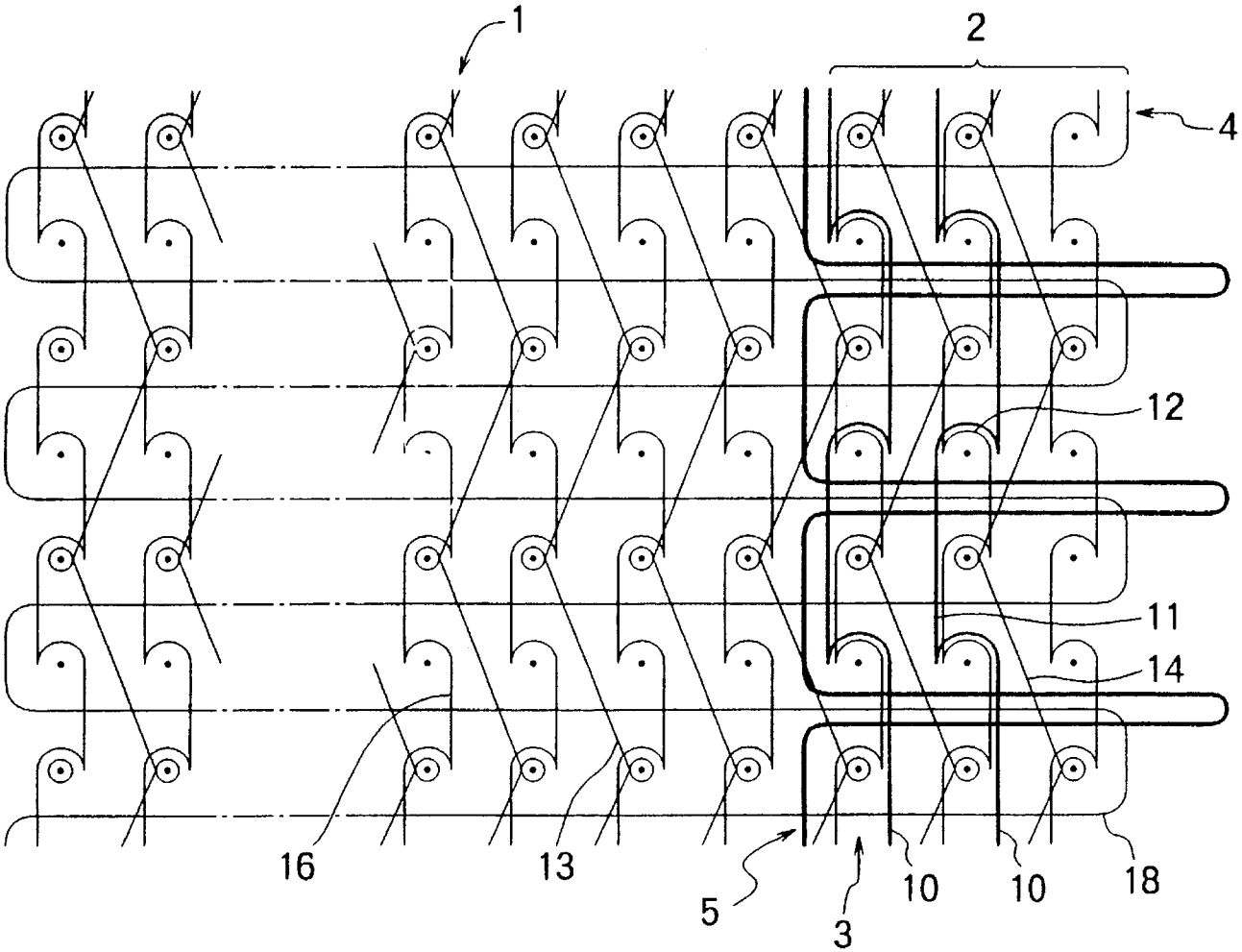
FIG. 1 is a point diagram showing a slide fastener knit by use of a single needle bed according to one preferred embodiment of the present invention.

Certain preferred embodiments of the present invention will be described below in greater detail with reference to the accompanying drawings. Referring now to FIG. 1, there is shown a point diagram of a knit slide fastener according to a first embodiment of the present invention.

Figures 2A, 2B, 2C:
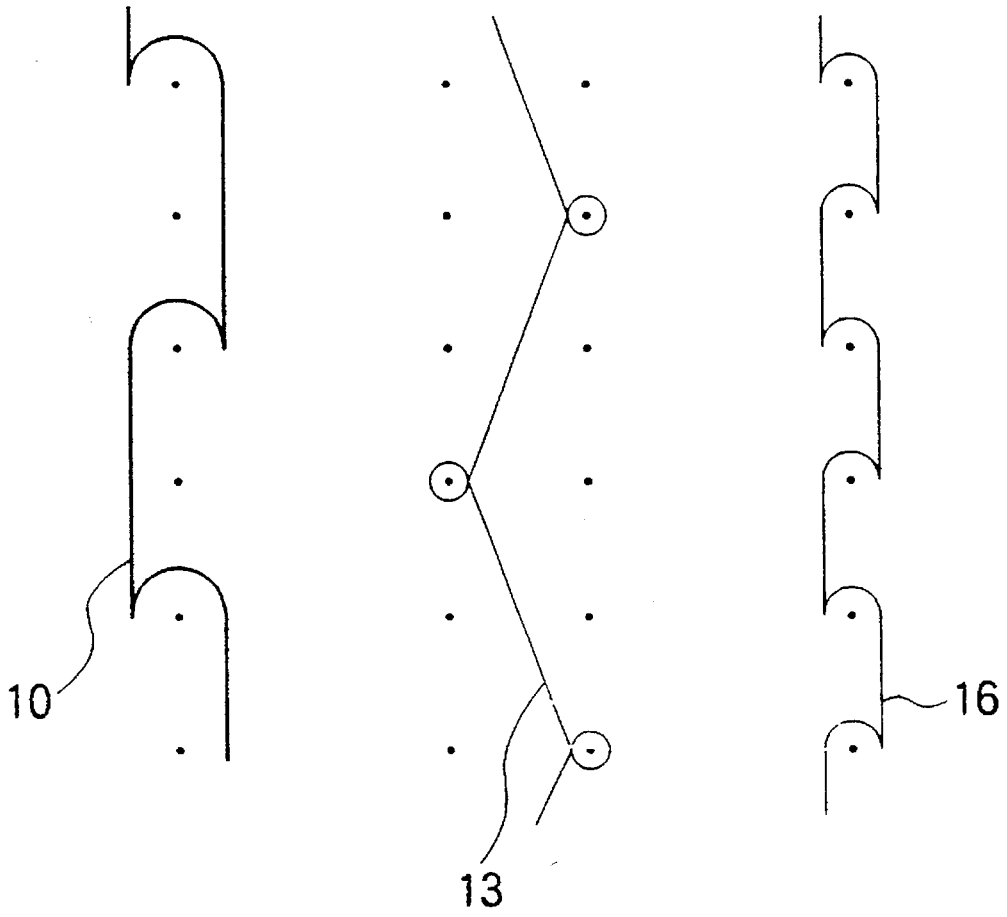
FIGS. 2(A)–2(C) are point diagrams showing the knitting patterns of various threads of FIG. 1.
Figure 3:
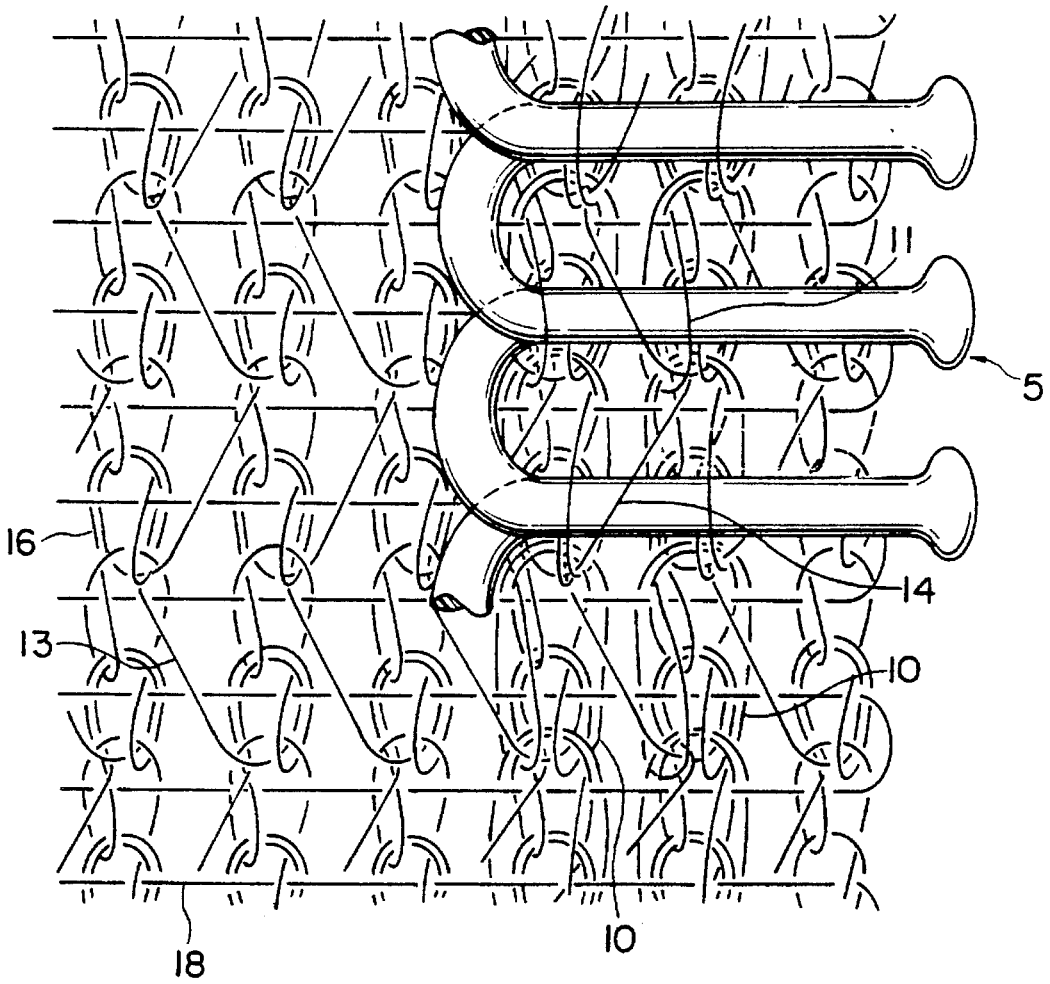
FIG. 3 is a diagrammatical plan view illustrative of the manner in which a row of continuous coiled coupling elements is attached to the slide fastener.

The knit slide fastener (hereinafter referred to as "fastener") is knit on a warp-knit machine of the general type having a single needle bed. The fastener includes a warp-knit fastener tape 1 having a ground structure knit with tricot stitches 13 having a pattern of (1-0/1-1/1-2/1-1 (FIG. 2(B)), chain stitches 16 having a pattern of (1-0/0-1 (FIG. 2(C)), and laid-in weft thread 18 laid in every course across the width of the fastener tape 1 and having a zigzag or meandering pattern. The fastener tape 1 has three adjacent wales 3 extending along one longitudinal edge portion of the fastener tape 1 and forming an element-supporting portion 2 to which a row of continuous helically coiled coupling elements 5 is attached. To form the row of coupling elements 5, a monofilament of synthetic resin is reciprocated one time in every other course 4 of the fastener tape 1 transversely across the element-supporting portion 2. The row of coupling elements 5 is secured to the element-supporting portion 2 by means of binding chain stitches 10 knit in a pattern of 0-0/0-1/1-1/1-0 (FIG. 2 (A)) and running along second and third outermost wales 3 to embrace the respective pair of legs 6, 7 of the coupling elements 5 from the above and hence urge them downwardly toward a surface of the element-supporting portion 2.

Figure 4:
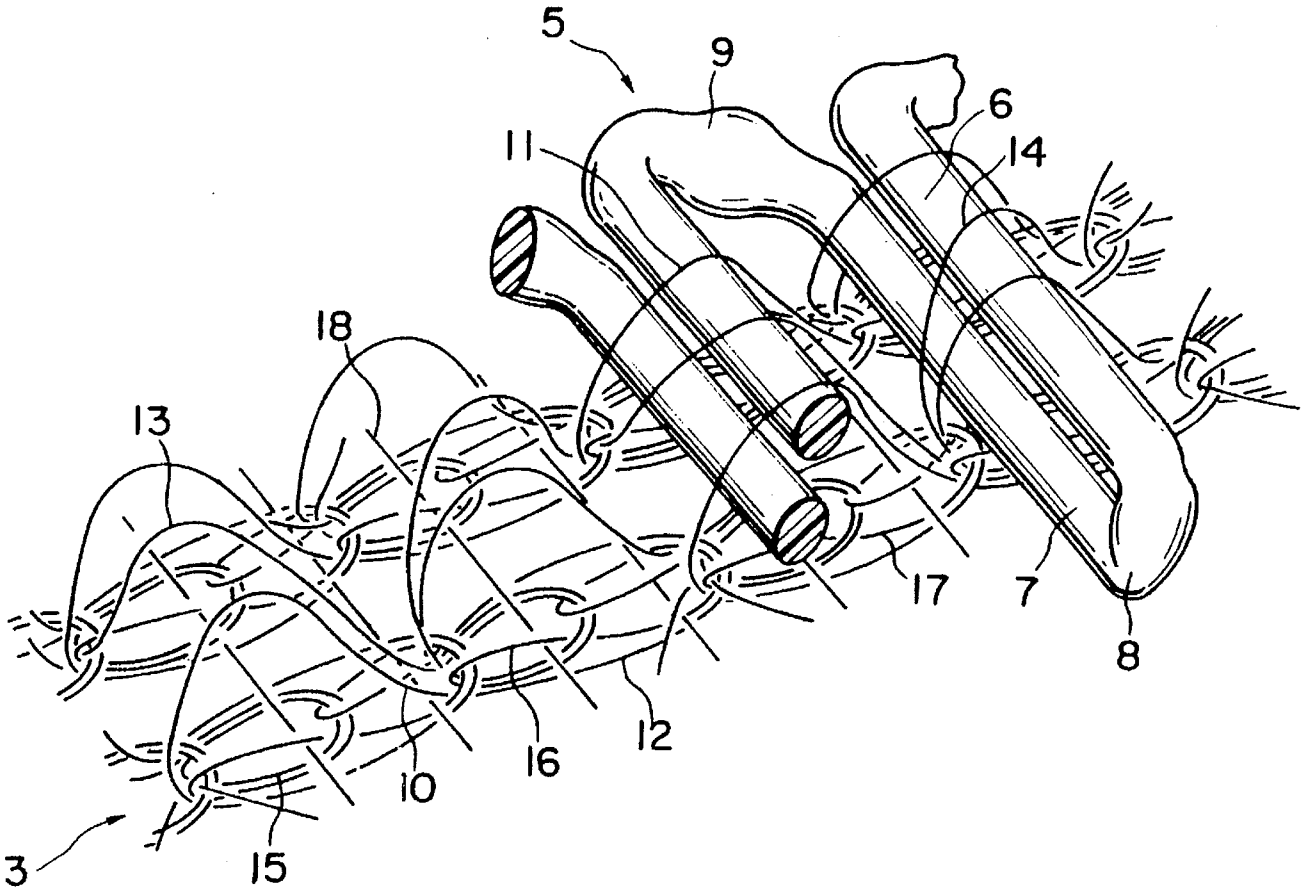
FIG. 4 is a perspective view showing a main portion of the slide fastener shown in FIG. 3.
Figure 5:
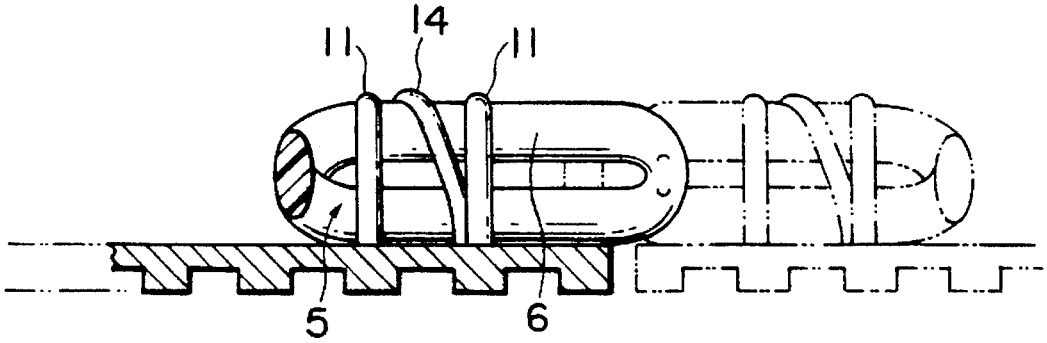
FIG. 5 is a transverse cross-sectional view of FIG. 4.

The row of continuous helically coiled coupling elements 5 which is attached to the element-supporting portion 2 of of the fastener tape 1 is formed from a monofilament of synthetic resin, such as nylon or polyester. The monofilament has a series of longitudinally spaced flattened portions previously formed thereon by stamping in preparation for a subsequent process of forming coupling heads 8 and connecting portions 9 (both shown in FIG. 4) of the coupling elements 5. The monofilament having such flattened portions is laid-in by reciprocating it in every other course 4 of the fastener tape 1 transversely across the element-supporting portion 2. The inlaid monofilament is bent at each of the flatted portions and continuously shaped into a row of continuous helically coiled coupling elements 5 each having the coupling head 8, a pair of legs 6, 7 extending in a common direction from the coupling head 8, and the connecting portion 9 remote from the coupling head 8 and interconnecting the upper leg 6 of one coupling element 5 and the lower leg 7 of the adjacent coupling element 5, as shown in FIG. 4. The row of coupling elements 5 is secured to the fastener tape 1 by means of the binding chain stitches 10 which are provided exclusively for this binding purpose and which are structurally independent from the chain stitches 16 of the ground structure.

As shown in FIG. 4, the binding chain stitches 10 extend along two adjacent wales 3 (the second and third outermost wales of the element-supporting portion 2). The binding chain stitches 10 have sinker loops 11 so arranged as to urge the respective pair of legs 6, 7 of the coupling elements 5 downwardly toward the ground structure of the fastener tape 1, and needle loops 12 intertwined with needle loops 17 of the chain stitches 16 of the ground structure. With the binding chain stitches 10 thus arranged, the element-supporting portion 2 has a knit structure which is made tight and substantially non-stretchable in the longitudinal direction. The row of coupling elements 5 attached to such element-supporting portion 2 is highly resistant to dimensional change or deformation. In the illustrated embodiment, the tricot stitches 13 partly forming the ground structure of the element-supporting portion 2 have sinker loops 14 so arranged as to urge the respective pair of legs 6, 7 of the coupling elements 5 downwardly toward the ground structure, and intertwined with the needle loops 17 of the chain stitches 16.

It is preferable that threads making up the binding chain stitches 10 and threads making up the tricot stitches 13 of the element-supporting portion 2 each have a thickness or diameter and a heat-shrinkability which are greater than those of the threads used to make up the ground structure. When subjected to a heat-setting process achieved after a slide fastener of the product length is produced, the thick and heat-shrinkable threads are thermally shrunk, thus producing a force tending to anchoring the row of coupling elements 5 more tightly against the element-supporting portion 2. The row of coupling elements 5 can, therefore, be secured firmly on the fastener tape 1 with improved dimensional stability. The partly stamped monofilament used in the aforesaid embodiment for forming the row of continuous helically coiled coupling elements 5 may be replaced with a monofilament having a rectangular or an oval cross section in which instance the stamping process required in the foregoing embodiment can be dispensed with, and the monofilament can readily be laid into the element-supporting portion 2 and subsequently shaped into a row of coupling elements 5.

Figure 6:
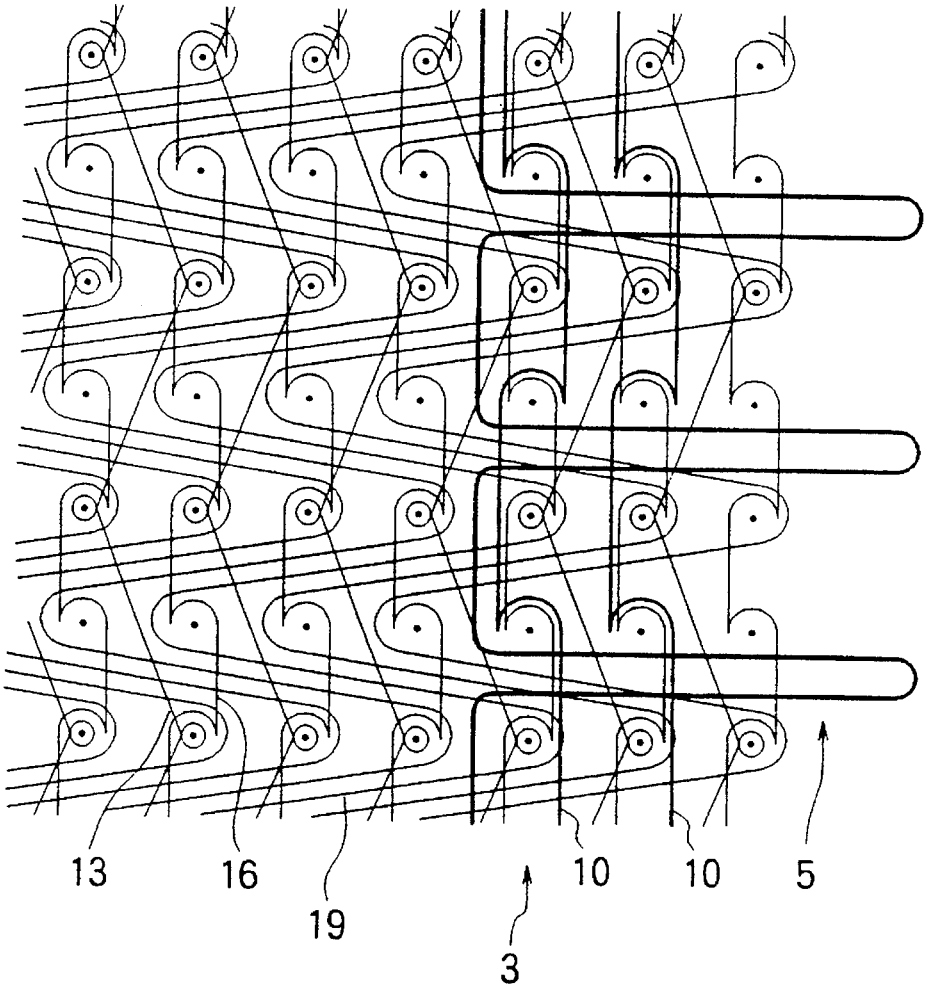
FIG. 6 is a point diagram showing a knit slide fastener according to a second embodiment of the present invention.
Figure 7:
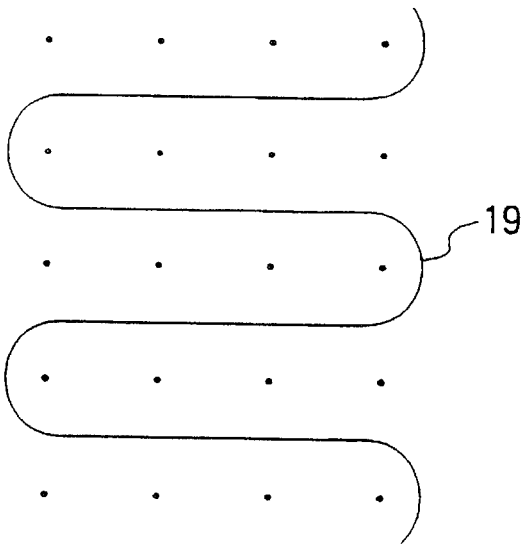
FIG. 7 is a point diagram of a laid-in weft thread in the knit structure of the slide fastener of FIG. 6.

A modified fastener shown in FIG. 6 is differentiated from one shown in FIG. 1 by using a plurality of laid-in weft threads 19 forming a portion of the ground structure of a fastener tape in place of the laid-in weft thread 18. The laid-in weft threads 19 have a thickness and a pattern which are different from those of the laid-in weft thread 18. More specifically, the laid-in weft threads 19 are laid in a pattern of 0-0/4-4 and each extend across four adjacent ones of the wales 3, as shown in FIG. 7. The laid-in weft threads 19 are thinner than the laid-in weft thread 18 of the first embodiment. By using the thin laid-in weft threads 19, it is possible to lower loads on the knitting needles applied when the ground structure is formed by knitting. Furthermore, the ground structure is not excessively thick and has a relatively high knitting density with the result that the fastener tape 1 is made highly stable in shape and configuration.

Another modified fastener shown in FIGS. 8 through 11 is substantially the same as the slide fastener shown in FIG. 1 with the exception that tricot stitches 20 used in place of the tricot stitches 13 of FIG. 1 have a different pattern and are used exclusively for forming a portion of the ground structure. The tricot stitches 20 have a pattern of 1-0/1-2 (FIG. 9) and are knit with the chain stitches 16 and the laid-in weft thread 18 so as to jointly form the ground structure of a fastener tape. As clearly shown in FIGS. 10 and 11, sinker loops 21 of the tricot stitches 20 extending in the element-supporting portion 2 have no function to secure the pair of legs 6, 7 of the coupling elements 5 and are knit solely as a portion of the ground structure of the fastener tape. The row of coupling elements 5 is secured by means of sinker loops 11 of the binding chain stitches 10. In the embodiment shown in FIG. 1, the sinker loops 14 of the tricot stitches 13 may be so arranged as to knit the ground structure of the fastener tape 1 rather than secure the coupling elements 5 to the element-supporting portion 2 of the fastener tape 1. In the case where the row of coupling elements 5 is secured only by means of the binding chain stitches 10, threads consisting the binding chain stitches 10 preferably have a thickness and a heat-shrinkability which are greater than those of any other knitting thread. By using such thick and highly heat-shrinkable threads of binding chain stitches 10, the coupling elements 5 can be fastened tightly with improved dimensional stability.

Figure 12:
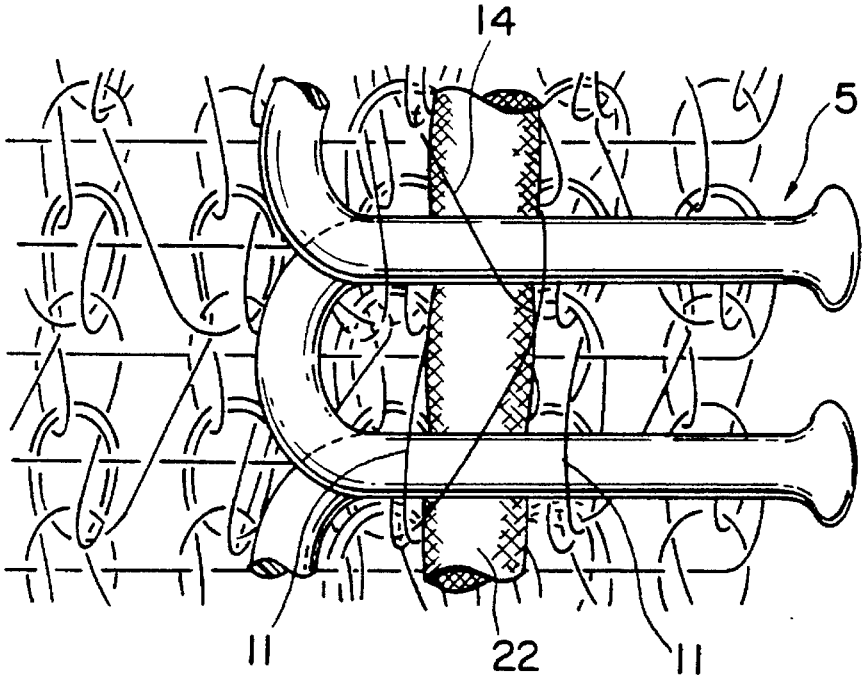
FIG. 12 is a diagrammatical plan view showing an element-supporting portion of a slide fastener according to a fourth embodiment of the present invention.
Figure 13:
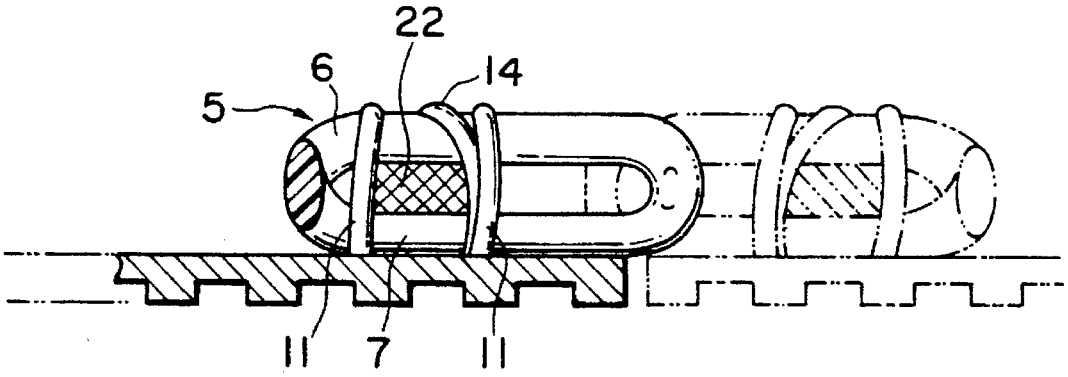
FIG. 13 is a transverse cross-sectional view of the element-supporting portion of FIG. 12.

FIGS. 12 and 13 show a modified fastener including a core cord 22 disposed between the upper and lower legs 6, 7 and extending along a row of continuous healically coiled coupling elements 5. The row of coupling elements 5 is secured to the fastener tape jointly by the sinker loops 11 of the binding chain stitches 10 and the sinker loops 14 of the tricot stitches 13, in the same manner as the embodiment shown in FIG. 1. The core cord 22 inserted through the row of coupling elements 5 may be used in the embodiment shown in FIG. 6.

Figure 8:
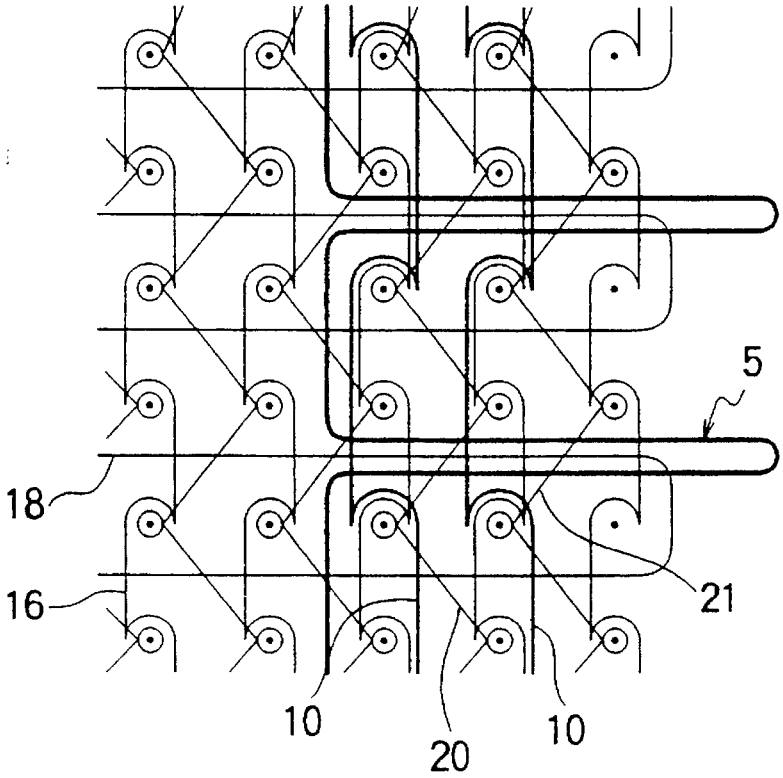
FIG. 8 is a point diagram showing a knit slide fastener according to a third embodiment of the present invention.
Figure 9:
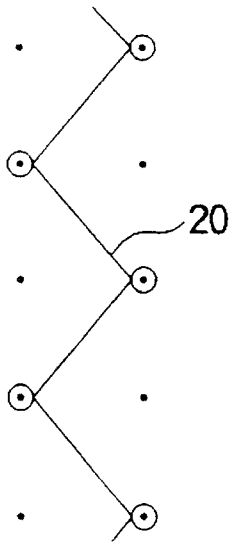
FIG. 9 is a point diagram of tricot stitches in the knit structure of the slide fastener of FIG. 8.
Figure 10:
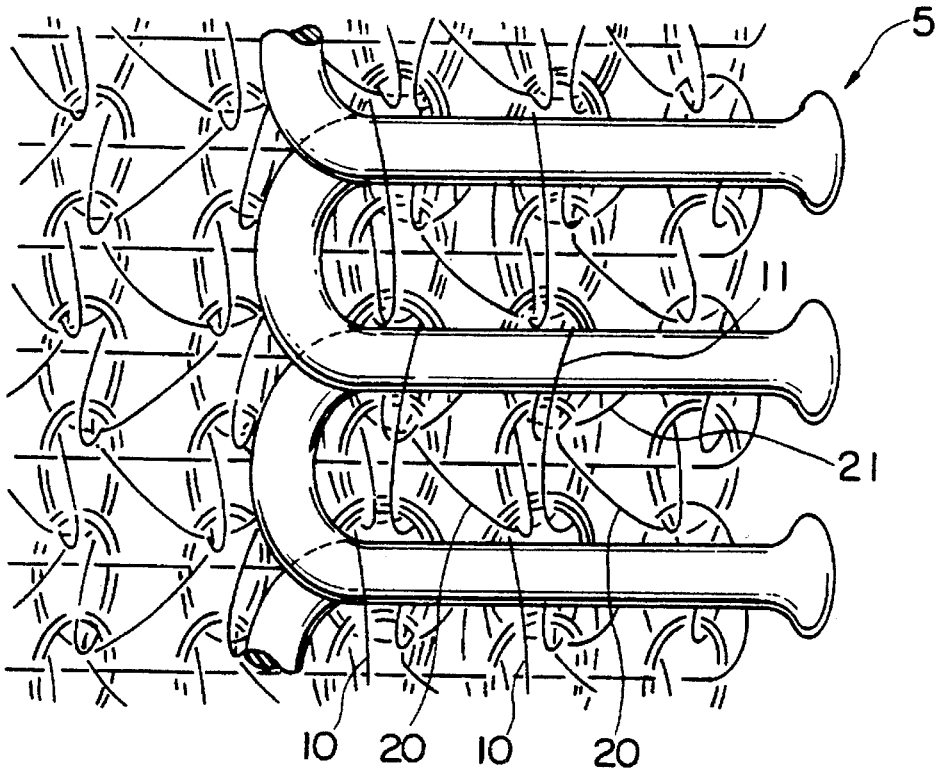
FIG. 10 is a diagrammatical plan view illustrative of the manner in which a row of continuous coiled coupling elements is attached to the slide fastener of FIG. 8.
Figure 11:
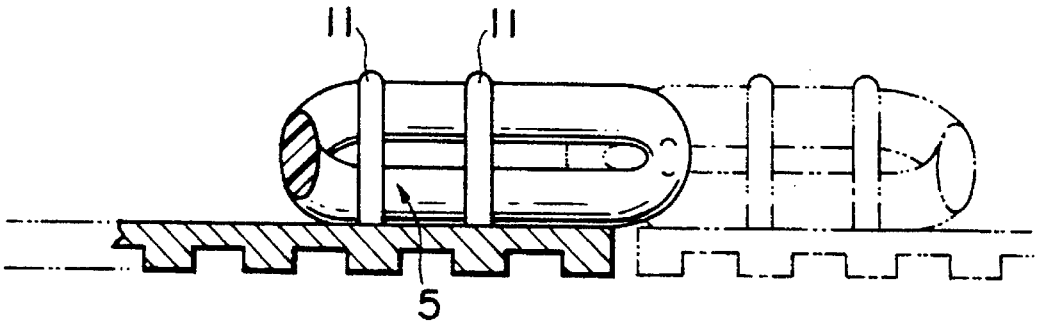
FIG. 11 is a transverse cross-sectional view of the slide fastener of FIG. 10.
Figure 14:
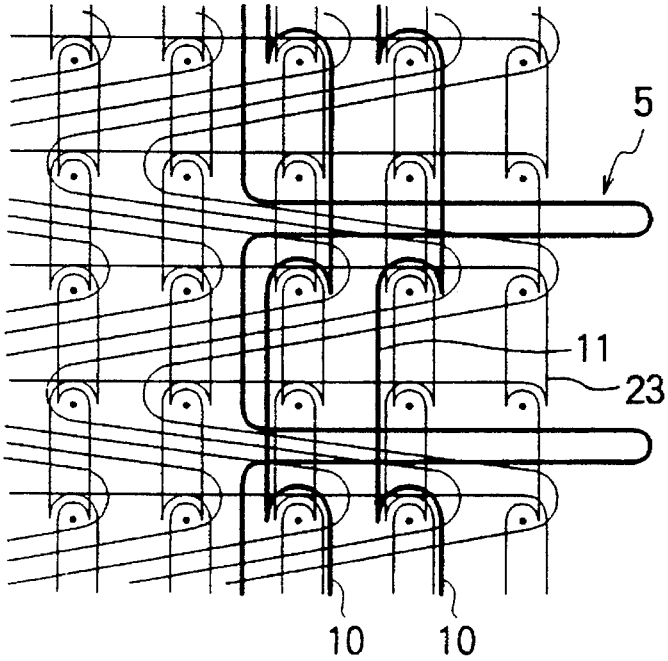
FIG. 14 is a point diagram showing an element-supporting portion of a slide fastener according to a fifth embodiment of the present invention.
Figure 15:
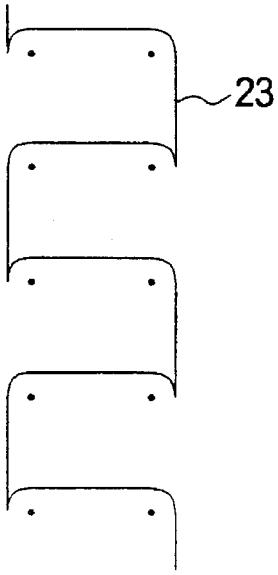
FIG. 15 is a point diagram of two needle stitches in the knit structure of the slide fastener of FIG. 14.

A modified fastener shown in FIG. 14 is differentiated from the embodiment of FIG. 8 by using two needle stitches 23 in place of the tricot stitches 20. The two needle stitches 23 have a pattern of 0-2/2-0, as shown in FIG. 15. In this embodiment, the row of coupling elements 5 is secured the fastener tape only by means of the sinker loops 11 of binding chain stitches 10.

As described above, the knit slide fastener of the present invention includes the row of continuous helically coiled coupling elements 5 knit into one longitudinal edge portion (element-supporting portion) 2 of the warp-knit fastener tape 1 as the fastener tape is knit, and binding chain stitches 10 knit with the ground structure of the fastener tape and arranged longitudinally along the element-supporting portion 2 so as to securely fasten the row of coupling elements 5 to the element-supporting portion 2 with sufficient dimensional stability. In the illustrated embodiments, the binding chain stitches 10 are composed of two threads running along two adjacent wales of the element-supporting portion 2. Three threads knit as the binding chain stitches may be used depending on the size of the coupling elements used. The width of the longitudinal tape edge portion (element-supporting portion) 2 is variable with the number of threads used to form the binding chain stitches, but in general, the width is equal to a total width of two or three adjacent wales of the fastener tape. An outermost wale may or may not be used for the purpose of securing the coupling elements 5. Since the outermost wale is likely to become compacted, it is preferable that a thicker knitting thread is used to form at least the outermost wale.

It is to be noted that in each of FIGS. 3, 4, 10 and 12, various threads are illustrated as having the same small thickness and being knit to form a coarse knit structure. This is only for purposes of illustration. In a practical use, various threads of different thickness are properly combined in view of various functional requirements prescribed for a desired fastener. Furthermore, the threads are knit together to form a fine or tight knit structure.

As is apparent from the foregoing description, a knit slide fastener of the present invention includes binding chain stitches 10 which are different from chain stitches 16 forming the ground structure of the warp-knit fastener tape 1 and which are used for securing the row of coupling elements 5 to the element-supporting portion 2 composed of the longitudinal edge portion of the fastener tape 1. The binding chain stitches 10 have the sinker loops 11 arranged to embrace the pairs of legs 6, 7 of the coupling elements 5 from the above and hence urge them toward a surface of the fastener tape 1, and the needle loops 12 intertwined with the needle loops 17 of the chain stitches 16 of the ground structure. With this construction, the element-supporting portion 2 has a fine or tight knit structure and substantially non-stretchable in the longitudinal direction. The row of coupling elements 5 attached to such element-supporting portion 2 is highly stable in position and resistant to deformation with the result that the slide fastener is always able to perform the necessary functions with high reliability.

Obviously, various minor changes and modifications of the present invention are possible in the light of the above teaching. It is therefore to be understood that within the scope of the appended claims the invention may be practiced otherwise than as specifically described.

What is claimed is:

1. A knit slide fastener having a warp-knit fastener tape composed of a ground structure including chain stitches, and a row of continuous coupling elements knit into and along an element-supporting portion of one longitudinal edge portion of said fastener tape as said fastener tape is knit, wherein the improvement comprises:

binding chain stitches knit into said longitudinal edge portion of said warp-knit fastener tape to secure said row of coupling elements, said binding chain stitches having sinker loops arranged to urge legs of said coupling elements toward said longitudinal tape edge portion, and needle loops intertwined with needle loops of said chain stitches of said ground structure.

2. A knit slide fastener according to claim 1, further including tricot stitches forming a portion of said ground structure, said tricot stitches having sinker loops arranged to urge said legs of said coupling elements toward said longitudinal tape edge portion in cooperation with said sinker loops of said binding chain stitches, and needle loops intertwined with said needle loops of said chain stitches of said ground structure.

3. A knit slide fastener according to claim 2, wherein at least said binding chain stitches are composed of heat-shrinkable threads having a greater thickness greater than threads consisting said ground structure.

* * * * *